United States Patent [19]

Zaruba et al.

[11] Patent Number: 4,708,348

[45] Date of Patent: Nov. 24, 1987

[54] PORTABLE GAME WITH CAPTIVE PARTS

[75] Inventors: John V. Zaruba, Chicago, Ill.; Steven P. Hanson, Richfield, Minn.; Wayne A. Kuna, River Forest, Ill.

[73] Assignee: Marvin Glass & Associates, Chicago, Ill.

[21] Appl. No.: 826,112

[22] Filed: Feb. 5, 1986

[51] Int. Cl.[4] ..... A63F 3/00

[52] U.S. Cl. ..... 273/246; 273/280; 273/281; 273/282; 273/287; 273/243; 273/288; 273/258

[58] Field of Search ..... 273/281, 282 R, 282 C, 273/246, 247, 287, 284, 288, 108, 273, 280, 285, 243, 258; 116/323, 324, 325, 223, 224, 225, 311, 312, 313, 314, 315

[56] References Cited

U.S. PATENT DOCUMENTS

| | | | |
|---|---|---|---|
| 1,993,679 | 3/1935 | Mosse | 273/246 |
| 2,953,379 | 9/1960 | Preston | 273/287 |
| 3,130,972 | 4/1964 | Schwarzlander | 273/282 R X |
| 3,266,724 | 8/1966 | Johnson | 273/281 X |
| 3,494,619 | 2/1970 | Biegonis | 273/288 X |
| 4,049,274 | 9/1977 | Jevons | 273/246 |
| 4,057,254 | 11/1977 | Gimes | 273/282 R |
| 4,513,974 | 4/1985 | Lin | 273/287 X |
| 4,607,847 | 8/1986 | Chung | 273/284 X |

FOREIGN PATENT DOCUMENTS

| | | | |
|---|---|---|---|
| 1957 | of 1863 | United Kingdom | 273/282 R |

*Primary Examiner*—Richard C. Pinkham
*Assistant Examiner*—Matthew L. Schneider
*Attorney, Agent, or Firm*—John S. Pacocha

[57] ABSTRACT

A game in which all of the pieces, while movable for play, are captured against removal and loss from the game. Player movable pieces are received for movement along slots extending through the thickness of a playing surface but are captured by upper and lower enlargements against removal. Discreet positional stops are provided along the slots by spaced apart depressions into which a mating truncated conical portion on the movable pieces fits. In one form, a captive rotatable disc cooperates with the playing surface to permit selective opening of covers that obscure indicia matchable with indicia designating positions along a slot path.

5 Claims, 15 Drawing Figures

PORTABLE GAME WITH CAPTIVE PARTS

BACKGROUND OF THE INVENTION

1. Field of the Invention

This invention relates generally to games, and more particularly to portable games with movable pieces.

2. Background Art

There are numerous games in the prior art with various movable player pieces, counters, and chance devices. A problem with such games is the possible loss of parts. The use of a playing surface attached spinner, or an enclosed die-popping mechanism, such as is disclosed in U.S. Pat. No. 3,356,369, eliminates the risk of loss of the chance device. Partial containment of movable player pieces is shown in the games of U.S. Pat. Nos. 1,673,705 and 3,130,972. There remains, however, a need for a game in which all of the parts are permanently secured to the playing surface so that parts are not lost while permitting movement of pieces needed for play of the game.

SUMMARY OF THE INVENTION

The present invention is concerned with providing portable games having movable player pieces, counters, and chance devices that are movable for play of a game but permanently captured against removal from the board. These and other objects and advantages of the present invention are achieved in a game having a generally planar bottom surface plus a playing surface of a predetermined thickness, both surfaces having generally the same periphery and being spaced apart from each other with one or more slot paths extending through the thickness of the playing surface. Player movable pieces extend upwardly from a stem slidable along the slot but are captured against removal from the slot by upper and lower enlargements. Discreet positional stops or steps for movement along a slot are created by spaced apart depressions in which a depending portion of the piece disposed between the upper enlargement and the stem is received. In addition to movable player token pieces, captive movable counter pieces and a chance device are also provided. In one form, a captive rotatable disc cooperates with the playing surface to permit selective opening of covers that obscure indicia matchable with indicia identifying positions along a slot path

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
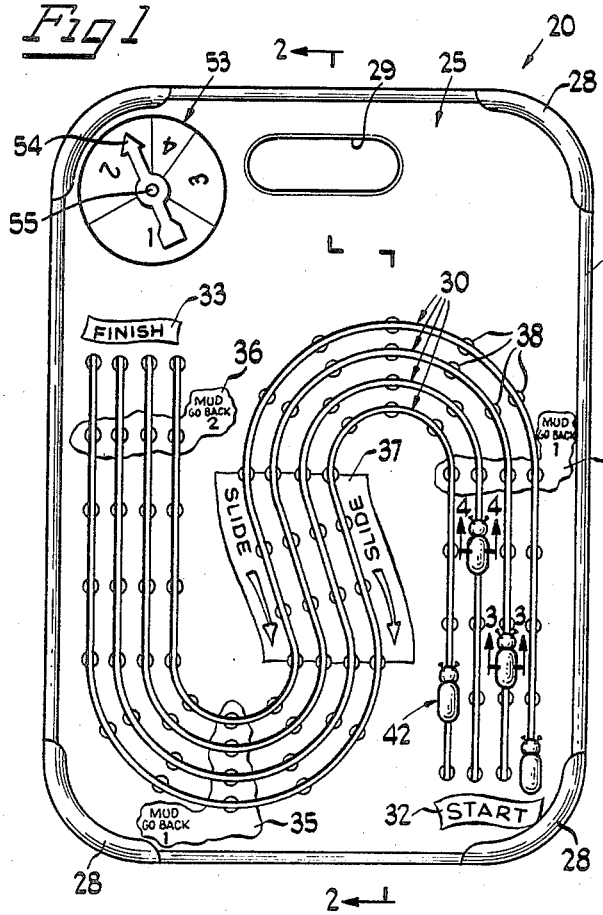
FIG. 1 is a top plan view of a game embodying the present invention.
Figure 2:
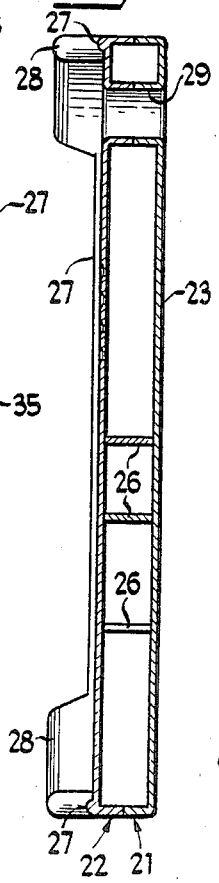
FIG. 2 is a sectional view taken generally along line 2—2 of FIG. 1.
Figure 3:
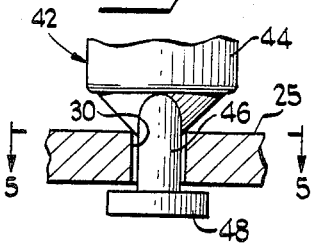
FIG. 3 is an enlarged scale sectional view taken generally along line 3—3 of FIG. 1.
Figure 4:
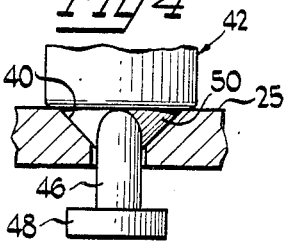
FIG. 4 is an enlarged scale sectional view taken generally along line 4—4 of FIG. 1.

Referring now to the drawings in which like parts are designated by like reference numerals throughout the several views, FIG. 1 shows a game 20 including mating top and bottom molded sections 21 and 22, respectively. Bottom section 21 includes a generally planar bottom surface 23 while the top surface of section 22 forms a playing surface 25. The two sections are secured by suitable adhesive, ultrasonic welding or other suitable fastening methods. Between bottom surface 23 and playing surface 25 there is a hollow chamber spanned by supporting spacers 26 at strategic locations. When the upper and lower sections are assembled they form a common periphery.

Projecting upwardly from the playing surface around the periphery of upper section 22 is a low wall or sill 27 that may be integrally formed with upper section 22. At each of the rounded corners, wall 27 increases in both thickness and height to form corner posts 28. The tops of corner posts 28 are higher than any other part of the game to facilitate the stacking of other games or boxes atop game 20. An opening 29 extends through from playing surface 25 to bottom surface 23 adjacent one end of the game to insert a hand for carrying.

Extending through the thickness of playing surface 25 are four spaced apart, generally parallel, serpentine slots 30. Each of the slots is of the same width and extends from one area on the board designated by a "START" graphic 32 to another common area designated by a "FINISH" graphic 33. Along the paths defined by parallel slots 30 are other graphics providing play direction such as the "MUD GO BACK 1" graphic 35, the "MUD GO BACK 2" graphic 36 and the "SLIDE" graphic 37. Spaced along each slot are a number of discreet position stops 38 formed by a tapered, or truncated conical, depression 40 extending from the playing surface part way down through the thickness.

Figure 5:
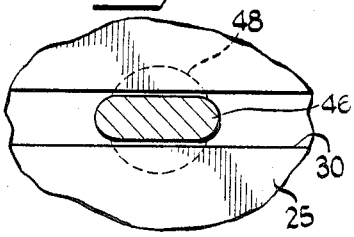
FIG. 5 is a sectional view taken generally along line 5—5 of FIG. 3.

Received in the slots for sliding movement along the path defined by each of the slots is a movable player token piece 42. Each piece 42 has an upper part 44 graspable by the player. Depending from the bottom of part 44 is a stem 46 having a cross section that fits loosely within each slot 30 to permit sliding movement of the piece. Stem 46 may be cylindrical in cross section or oblong, as shown in FIG. 5. With a cylindrical cross section, the graspable part 44 above the playing surface is rotatable relative to the playing surface while the oblong cross section maintains a particular rotational orientation of the piece. The bottom of part 44 is larger in cross section that the width of slot 30 in at least two dimensions that are substantially transverse to each other. At the bottom of the stem there is a lower enlargement or circular boss 48, the diameter of which is greater than the width of slot 30. Between the upper and lower enlargements, stem 46 is longer than the thickness of the playing surface.

Below the bottom of part 44 and the upper end of the length of stem 46 is a truncated conical portion 50 that fits into each of the depressions 40. The distance between the end of the truncated conical portion and the top surface of lower enlargement 48 is greater than the thickness of the playing surface to permit movement of playing piece 42 along the slot. As playing piece 42 is moved between adjacent position stops 38, the portion 50 bears along the upper edges of the slot. When the piece has been moved a predetermined distance along the slot, portion 50 drops into depression 40 providing a discreet stop.

Also made a captive part of game 20 is a spinner chance device 53 having a number of radial divisions designating movements of "ONE", "TWO", "THREE", or "FOUR". A pointer 54 mounted for rotation about a central axis 55 is manually spun by the player to determine the number of moves for each turn. Players proceed in accordance with the spinner designation to move a respective token piece 42 along the slot path from "START" 32 to "FINISH" 33. Should the player stop in either of the two mud puddles 35, the player is directed to "GO BACK 1". Landing in the mud area 36 just before "FINISH" 33 requires the player to "GO BACK 2". If the player's movable piece stops at the end of a turn anywhere within "SLIDE" area 37, the player is permitted to advance the piece to the last stop at the bottom of the "SLIDE". The first player to reach "FINISH" wins.

Figure 6:
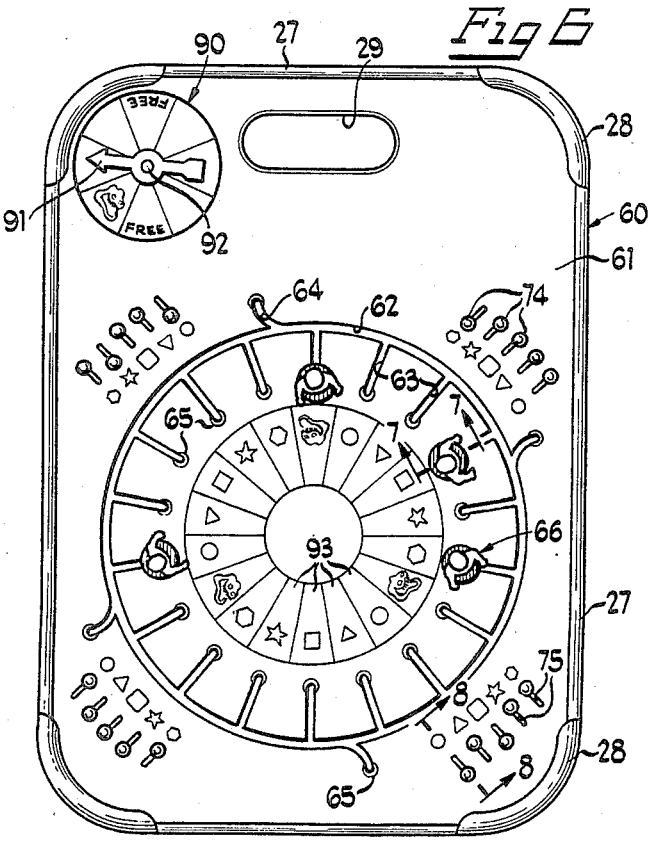
FIG. 6 is a top plan view of another game embodying the present invention.

Another game 60 embodying the present invention is shown in FIG. 6. Like game 20, game 60 is assembled of mating upper and lower sections. Game 60 is also provided with peripheral wall 27, raised corner posts 28 and hand opening 29 to facilitate carrying of the game. A playing surface 61 has a circular slot 62 from which a number of radial slots 63 project inwardly at regular intervals. In addition, an outwardly extending starting slot 64 is provided for each player. All of the slots are of substantially the same thickness. The inner end of each slot 63 and the outer end of each slot 64 has a conical depression 65 forming a position stop as in the previous embodiment.

Figure 7:
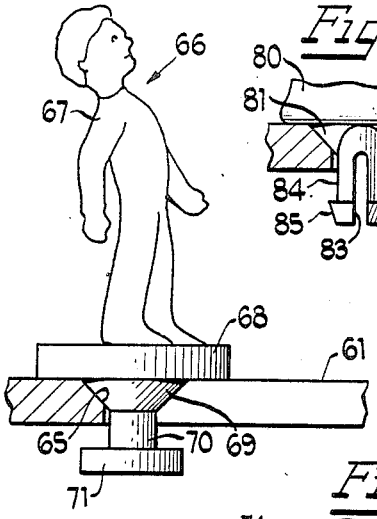
FIG. 7 is an enlarged scale sectional view taken generally along line 7—7 of FIG. 6.

Captured within the slots for movement along the paths defined by the slots is a movable piece 66 for each player. As with piece 42, movable piece 66 includes an upper player graspable portion 67, that is, in this embodiment, styled as a human figure atop a base disc 68, the diameter of which is greater than the width of the slots. Depending from the bottom of the disc is a truncated conical portion 69 that joins a depending stem 70, the bottom of which has a lower enlargement 71. The length of stem 70 between the upper face of lower enlargement 71 and the bottom of truncated conical portion 69 is greater than the thickness of playing surface 61 so that piece 66 may be pulled up from the position shown in FIG. 7 and moved along the slot.

In addition to movable player pieces 66, each player is provided with five movable counters or markers 74, each of which is shiftable between two positions in a respective slot 75. Similar to the movable player token pieces, each counter has an upwardly projecting player graspable portion 76, the bottom of which has at least two dimensions, substantially transverse to each other, that are greater than the width of slot 75. A stem 77, having a cross section that permits movement along slot 75, depends from the bottom of part 76. Stem 77 has on its bottom an enlargement 78, which again has at least two dimensions, substantially transverse to each other, and greater than the width of slot 75.

Figure 9:
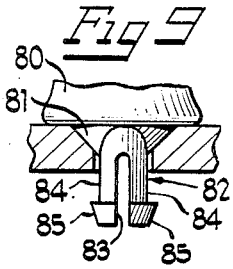
FIG. 9 is an enlarged scale sectional view of an alternative embodiment of the present invention.
Figure 8:
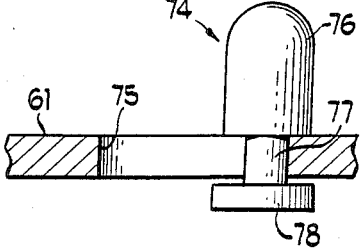
FIG. 8 is an enlarged scale sectional view taken generally along line 8—8 of FIG. 6.

An alternative form of securing the movable pieces within their respective slots is shown in FIG. 9. Again the piece is provided with an upper enlargement extending up to provide a player graspable part 80, a depending truncated conical section 81, and a stem 82. However, stem 82 is bifurcated by a slit 83 extending up from its bottom forming spread apart portions 84 that may be squeezed together. Adjacent the bottom of stem 82, barbs 85 extend, outwardly and then downwardly toward the bottom, around each of the split portions 84. Stem 82 is made of a sufficiently resilient material so that the two split portions and their respective barbs may be squeezed together about the slit 83 to force the lower part of stem 82 through one of the slots. After insertion, the split portions and barbs then return back to their spread apart condition. The dimensions of the top of barbs 85 are such that in the spread apart conditions there are at least two dimensions generally transverse to each other, that are greater than the width of the slot.

On playing surface 61 there is a spinner 90 having eight equal radial divisions. Two of the divisions have a "FREE" designation, another bears a graphic of an open mouthed monster, and the remaining five each have a different color. A pointer 91 is mounted for rotation on the spinner about a central axis 92. Each of the eighteen slots 63 terminate in proximity to a radial segment 93 forming part of an annular ring generally in the center of circular slot 62. In each segment 93 is one of the five colors of the five colored spinner divisions plus a graphic of either the open mouthed monster or one of five distinct geometric shapes. The monster and each of the geometric shapes are each repeated three times. At one end of each of each player's slots 75, one of each of the five geometric shapes contained in segments 93 is shown.

To play game 60, players spin and move clockwise from their respective starting slot 64 to the first color segment 93 that matches the color on the spinner. Upon landing on a color, the player finds the shape in front of the player's counter pieces 74 that matches the shape just landed on and counts or marks it by sliding piece 74 toward the shape graphic. Should the player's spin stop on a "FREE" division, the player's piece 66 may be moved to any space chosen by the player who may then advance the counter for that shape. However if the player spins a monster, the piece 66 is moved to the nearest monster segment 93 and the player loses one of the previously counted shapes. The player must then move the counter 74 for that shape back away from the graphic. As soon as a player collects all five shapes, the game is won.

Yet another game 100 embodying the present invention is shown in FIGS. 10–15. The peripheral wall 27, corner posts 28 and hand opening 29 are all substantially as previously described. Game 100 is similarly assembled of upper and lower mating sections 102 and 103. The playing surface on section 102 has an arcuate slot 104 with ten discreet stops 106 extending from each end of the arcuate slot toward its center. Stops 106 are similar to stops 65 and 38 of the previous embodiments. A player movable piece 66 is provided for each of two players. In the center of the arcuate path is a goal 108 that may be styled as a barn. Inwardly of slot 104, adjacent each of the stops 106, is one of five different graphic animal indicia 110.

A disc 112, mounted for rotation within a circular opening 113 in the center of the arcuate slot, has a raised central knob portion 114 from the center of which an integral, internal mounting post 116 depends. Disposed beneath disc 112 is a support plate 118, integrally formed as part of lower section 103, and secured by a screw 119 or other suitable fastener to a mounting post 120 depending from the playing surface of upper section 102. Disc 112 is secured to plate 118 for rotation by a fastener 122 in mounting post 116.

Five generally rectangular openings 124 are spaced apart at approximately seventy-two degree intervals around disc 112 with an open end generally contiguous with the circular periphery of the disc. Each opening 124 is closed by a cover 125 that generally conforms in shape to opening 124 and has an edge 126 generally contiguous with the periphery of the disc. The top of cover 125 lies generally in the same plane as the top of disc 112. Extending upwardly from adjacent the inner edge, that is opposite edge 126, is a generally upright tab 128 that may be grasped by the player.

Figure 11:
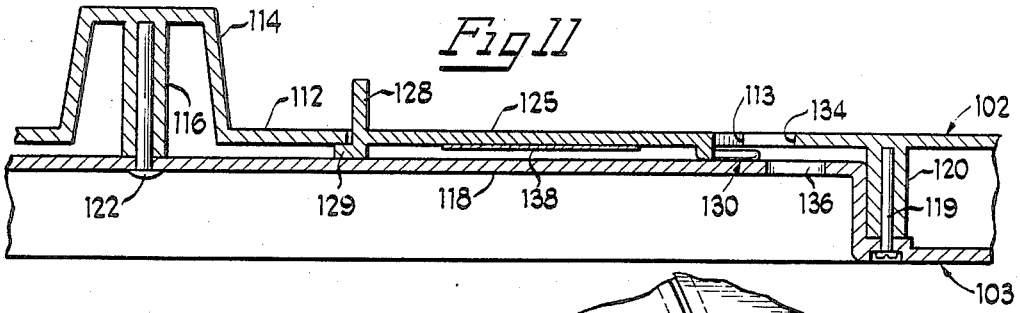
FIG. 11 is an enlarged scale sectional view taken generally along line 11—11 of FIG. 10.
Figure 12:
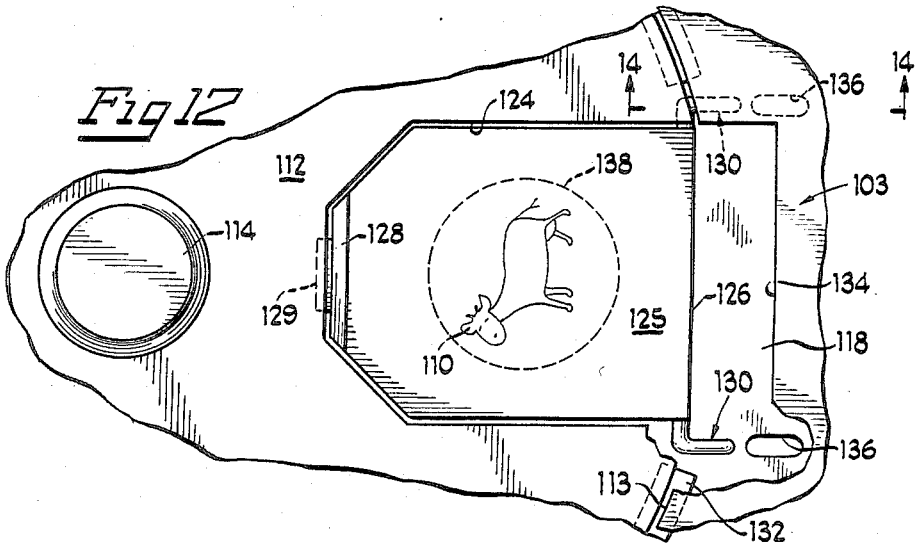
FIG. 12 is a top plan view of FIG. 11.

Below the principal part of cover 125 and tab 128 is a lip 129 that extends in toward the center of disc 112 from the inner edge of the cover. Both lip 129 and tab 128 may be formed as integral parts of cover 125. As is shown in FIG. 11, lip 129 fits between the bottom of disc 112 and the top of support plate 118 to latch cover 125 against upward movement. Extending out from each lateral side of cover 125 adjacent edge 126 is an "L" shaped pin 130. The short leg of each "L" shaped pin extends out laterally generally parallel to edge 126 and the long leg then extends out away from the center of the disc, generally perpendicular to edge 126. Pins 130 lie upon plate 118 and together with lip 129 support cover 125 for sliding movement atop the plate.

Between openings 124 there is a short ledge 132 extending out from the peripheral edge of disc 125 that engages the underside of the playing surface to prevent disc 112 from being pulled out of opening 113. In the periphery of circular opening 113 there are two rectangular cutouts 134 that are generally of the same width as openings 124 so that a cover 112 may be slid outwardly along support plate 118 to disengage lip 129. Outboard of each lateral side of each of cutouts 134 there is an oblong opening 136 in support plate 118. Each of the oblong openings is aligned with, and of a greater length than, the longer leg of each respective "L" shaped pin 130.

Figure 14:
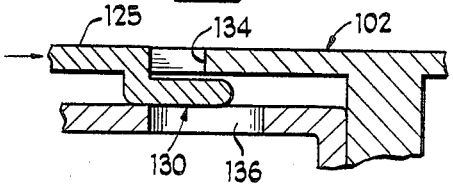
FIG. 14 is an enlarged scale sectional view taken generally along line 14—14 of FIG. 12 showing movement of some parts relative to each other.
Figure 15:
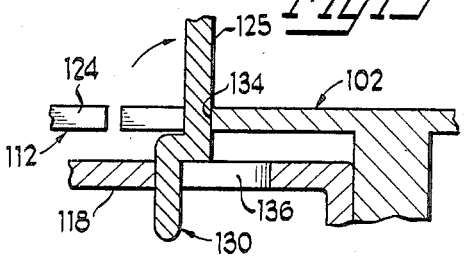
FIG. 15 is another sectional view taken generally along line 14—14 of FIG. 12 showing further movement of the parts relative to each other.

Unless an opening 124 is in register with one of the openings 134, cover 125 is restrained against the outward movement necessary to disengage lip 129 by the periphery of the circular opening 113. However, once an opening 124 is in register with a cutout 134, the player, grasping tab 128, may slide cover 125 outwardly disengaging lip 129 and then begin to lift up the inner end of cover 125. As a cover 125 is slid outwardly, the pins 130, which, in the latched position of cover 125, are spaced from the respective oblong openings 136, then have a substantial part of the longer leg positioned over the oblong opening as shown in FIG. 14. The player may then begin to pull up on tab 128 pivoting the leg of pin 130 down into and through opening 136 to raise cover 125 to a generally upright position as shown in FIG. 15. On the underside of cover 125 is a decal 138, or the like, with one of the graphic animal indicia 110. Each of the five covers 125 bear a different one of the animal indicia on its underside.

Figure 10:
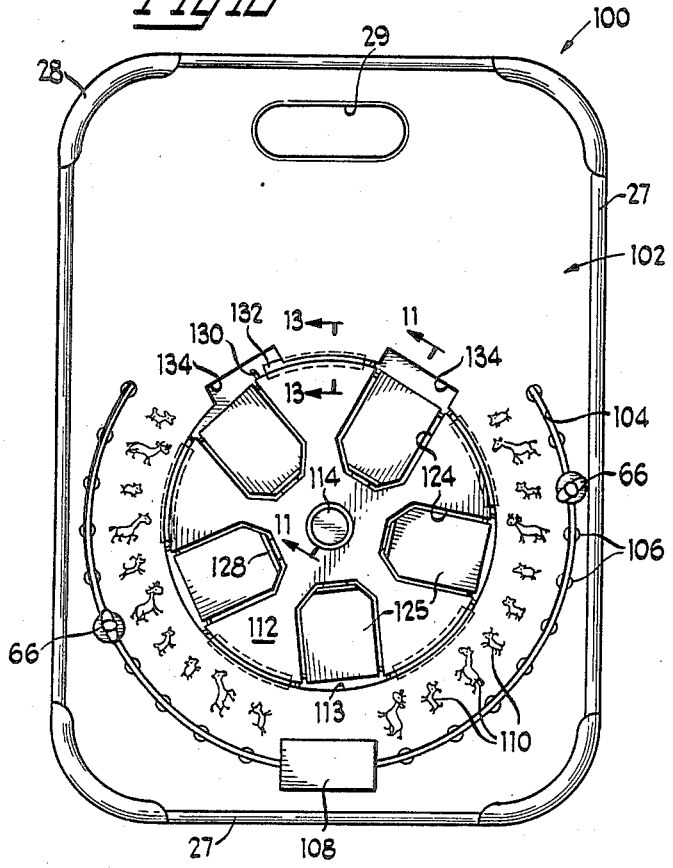
FIG. 10 is a top plan view of yet another game embodying the present invention.
Figure 13:
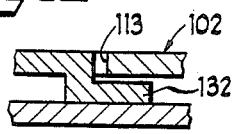
FIG. 13 is an enlarged scale sectional view taken generally along line 13—13 of FIG. 10.

The respective centers of the two cutout portions 134 are spaced apart, as shown in FIG. 10, less than seventy-two degrees although they could be spaced apart more than seventy-two degrees. Cutouts 134 are spaced apart other than a multiple of seventy-two degrees so that only one opening 124, and its respective cover 125, may be registered with a cutout 134 to permit opening of the cover at any one time. Two of such cutouts are provided so that before starting play of a new game, the players may change the sequence of the obscured animal indicia by first indexing an opening 124 with one of the cutouts 134, sliding the cover outwardly and opening it up to the position shown in FIG. 15. Then, leaving that particular cover 125 in the cutout 134, disc 112 is indexed to the second cutout portion 134 where another one of the covers 125 may be opened and stored. The disc may then be indexed again to put the cover 125 left in the first cutout portion into the opening 124 in order to change the sequence. In play, a particular cover 125 is chosen by the player, indexed to a cutout and opened to determine if the player has uncovered an animal indicia 110 corresponding to the indicia adjacent the next stop 106 to which the player must move piece 66 in an advance toward the goal 108. The first player to reach the goal wins.

While particular embodiments of the present invention have been shown and described with some alternatives and variations, further changes and modifications will occur to those skilled in the art. It is intended in the appended claims to cover all such alternatives, variations, changes and modifications as fall within the true spirit and scope of the present invention.

What is claimed as new and desired to be secured by Letters Patent is:

1. A portable game comprising:
a generally planar bottom surface;
a playing surface spaced from the bottom surface and having a predetermined thickness;
pieces movable by a player during play of the game;
the playing surface including a slot receiving the player movable pieces;
a slot extending through the thickness;
means capturing the pieces against removal from playing surface;
the slot including discreet spaced apart positions along the path defined by truncated conical depressions; and the pieces including a stem extending therefrom, said stem having an enlargement at each end thereof and a truncated conical section located therebetween that fits into the depression.

2. A portable game comprising:
a generally planar bottom surface;
a playing surface spaced from the bottom surface and having a predetermined thickness;
pieces movable by a player during play of the game;
the playing surface including a slot receiving the player movable pieces;
the slot extending through the thickness;
means capturing the pieces against removal from the playing surface;
means defining discreet positions along the slot;

a plurality of indicia identifying the discreet positions of the slot;

a plurality of obscured indicia that may be selectively exposed one at a time;

means limiting exposure of the obscured indicia to one at a time; and each of the selectable obscured indicia corresponding to one of the indicia identifying a discreet position along the slot.

3. A portable game comprising:

a generally planar bottom surface;

a playing surface spaced from the bottom surface and having a predetermined thickness;

pieces movable by a player during play of the game;

the playing surface including a slot receiving the player movable pieces;

the slot extending through the thickness;

means capturing the pieces against removal from the playing surface;

means defining discreet positions along the slot;

a plurality of indicia identifying the discreet positions of the slot;

a plurality of obscured indicia that may be selectively exposed one at a time;

each of the selectable obscured indicia corresponding to one of the indicia identifying a discreet position along the slot;

a disc mounted for rotation about an axis generally perpendicular to the playing surface;

a number of openable covers carried by the disc;

each of the selectable indicia obscured by one of the covers; and means retaining the covers in their closed condition until the disc is registered with a notch in the playing surface permitting movement of the cover from the closed condition to an open condition exposing the indicia.

4. The game of claim 3 including means supporting the cover for sliding movement in a generally radial direction with respect to the disc and pivotal movement between a position generally in the plane of the disc to a generally transverse position.

5. The game of claim 4 in which:

the cover is generally rectangular and has an outer edge generally contiguous with the peripheral edge of the disc;

extending outwardly from each side that is generally transverse to the edge, adjacent to, and generally parallel to, the edge is an "L" shaped pin;

a support plate is carried by the game disposed below the disk and cover; and each of a pair of spaced apart oblong openings are aligned with the one leg of the "L" shaped pin generally transverse to the edge.

* * * * *